US005685738A

United States Patent [19]

Harting et al.

[11] Patent Number: 5,685,738

[45] Date of Patent: Nov. 11, 1997

[54] PLUG-IN CONNECTOR WITH FASTENING MEANS

[75] Inventors: Dietmar Harting, Espelkamp, Germany; Jean-Merri de Vanssay, Paris, France

[73] Assignee: Harting Elektronik GmbH, Germany

[21] Appl. No.: 610,478

[22] Filed: Mar. 4, 1996

[30] Foreign Application Priority Data

Mar. 9, 1995 [DE] Germany ..... 195 08 409.8

[51] Int. Cl.[6] ..... H01R 13/73

[52] U.S. Cl. ..... 439/573; 439/607

[58] Field of Search ..... 439/573, 571, 439/572, 607

[56] References Cited

U.S. PATENT DOCUMENTS

| | | | |
|---|---|---|---|
| 4,639,066 | 1/1987 | Shimamiya et al. . | |
| 4,915,652 | 4/1990 | Madara | 439/607 |
| 5,079,671 | 1/1992 | Garrett et al. | 439/79 |
| 5,125,853 | 6/1992 | Hashiguchi | 439/607 |
| 5,228,873 | 7/1993 | Hirai | 439/573 |
| 5,249,983 | 10/1993 | Hirai | 439/573 |
| 5,470,261 | 11/1995 | Embo et al. | 439/752 |

FOREIGN PATENT DOCUMENTS 7541652 12/1975 Germany .

*Primary Examiner*—Gary F. Paumen

*Attorney, Agent, or Firm*—Dorn, McEachran, Jambor & Keating

[57] ABSTRACT

For a plug-in connector with a metal shield with fastening means for fastening to a fastening surface, it is proposed, for the conductive connection of the metal shield to the fastening surface, that an approximately T-shaped, electrically conductive fastening part be inserted in the flanges of the plug-in connector, and that cut-out tongues on the metal shield be stamped under the upper region/head of the fastening part in such a way that the latter is, on the one hand held, and on the other hand, pressed against the cut-out tongues when the plug-in connector is bolted on.

3 Claims, 2 Drawing Sheets

PLUG-IN CONNECTOR WITH FASTENING MEANS

THE FIELD OF THE INVENTION

The invention relates to a plug-in connector with fastening means for fastening to a fastening surface on a printed circuit board or the like, the plug-in connector being provided with fastening flanges at its ends, a fastening part provided with a threaded passage is arranged in a recess in each flange, and the plug-in connector having a metal shield enveloping the insulating body of the plug-in connector.

In plug-in connectors provided with metal shields, the metal shield must have a satisfactorily conductive connection with the fastening surface, that is to say, for example, with the surface of a conductor web on a printed circuit board, onto which the plug-in connector is fitted. It is known practice to locate the metal shield a short distance above the fastening flanges of the plug-in connector, and to bolt the metal shield, together with the insulating body of the plug-in connector, to the fastening surface by means of a bolt in the region of the flange. Under these circumstances, a conductive connection is produced between the metal shield and the fastening surface via the bolt, the head or nut of which makes contact on the metal shield. It is also known practice to insert, in recesses in the flanges of plug-in connectors, nuts into which a fastening bolt can be screwed, by means of which the plug-in connector can be bolted fast to a fastening surface. In plug-in connectors with this type of fastening, however, no metal shield is provided.

The underlying object of the invention is to construct a plug-in connector of the type initially mentioned in such a way that the connector has a simple bolt fastening and a reliable electrical connection between the metal shield and the fastening surface is achieved when bolting-on is effected.

This object is achieved through the fact that the fastening part is of approximately T-shaped construction and is manufactured from electrically conductive material, its upper part being of rectangular shape and having two oppositely located recesses, so that four outwardly extending arms are formed; that the fastening part is inserted from above in the recess in the flange in question in such a way that the arms extend at the sides of the plug-in connector, the underside of the fastening part being at an interval from the underside of the plug-in connector; that the metal shield is inverted over the insulating body, lateral parts of the metal shield engaging the upper surfaces of the ends of the arms of the fastening part; and that there are provided, in the lateral parts of the metal shield in the region of the arms of the fastening part, cut-out tongues which are impressed inward toward the center of the fastening part, the said tongues being pressed against the bottom edges of the arms and pressing the fastening part, in the region of the flanges, against the inside of the metal shield.

The advantages achieved by means of the invention consist particularly in the fact that the nut-like fastening part can be inserted in a simple manner in the correspondingly-shaped recesses in the flange of the plug-in connector, is held in a non-twistable manner and is held, after the putting-on of the metal shield and the impressing of the holding tongues, in a non-loosenable manner, and that when the plug-in connector is bolted on, edges of the fastening part are drawn/pressed against the lateral surfaces of the impressed holding tongues, a satisfactory electrical contact is achieved.

BRIEF DESCRIPTION OF THE DRAWINGS

An example of embodiment of the invention is represented in the drawings and will be explained in greater detail below.

FIG. 5(*b*) is a side elevational view of the fastener of FIG. 5(*a*);

FIG. 5(*c*) is a top plan view of the fastener of FIG. 5(*a*); and

DESCRIPTION OF THE PREFERRED EMBODIMENT

Figures 1, 2, 3:
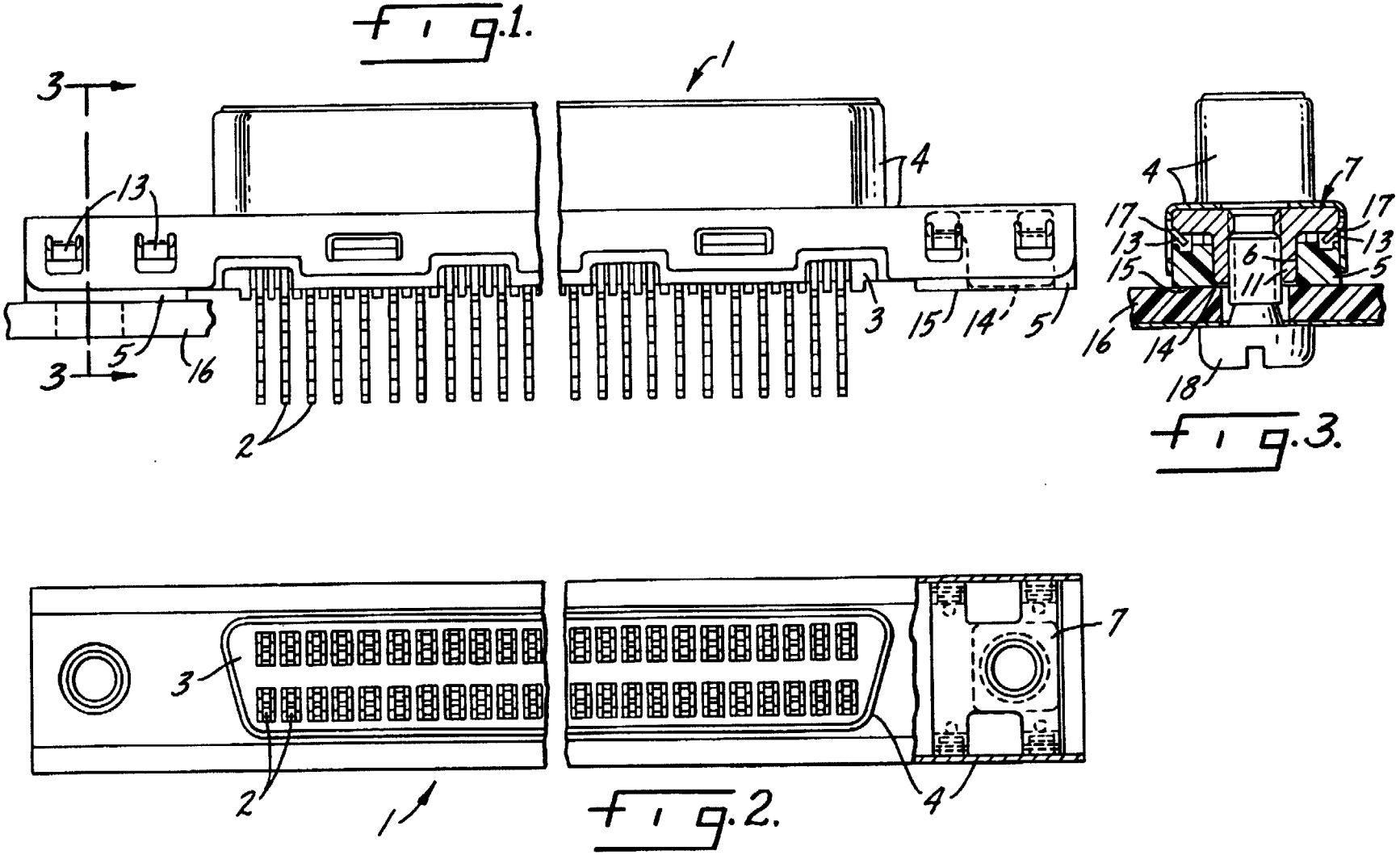
FIG. 1 is a side elevational view of the plug-in connector with parts broken away.
FIG. 2 is a top plan view of the plug-in connector illustrated in FIG. 1 with parts broken away.
FIG. 3 is a section through the flange of the plug-in connector illustrated in FIG. 1, taken along the line 3—3.
Figure 4:
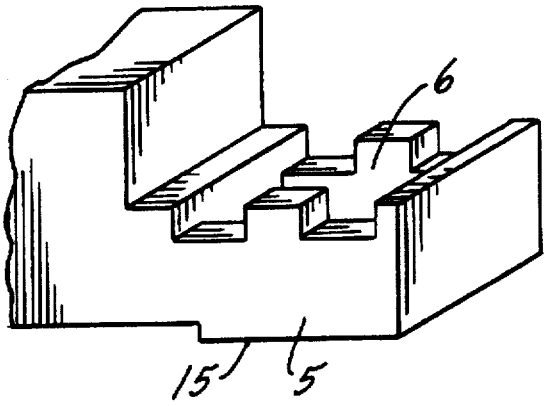
FIG. 4 is a partial perspective of the flange of the plug-in connector.

The plug-in connector 1 represented in FIGS. 1–3 essentially consists of an insulating body 3 which contains contact elements 2 and is provided with a metal shield 4. The insulating body is provided with lateral fastening flanges 5. In its lower region, the metal shield is of approximately U-shaped construction, so as to engage over the insulating body, and extends above the flanges.

Figure 5B:
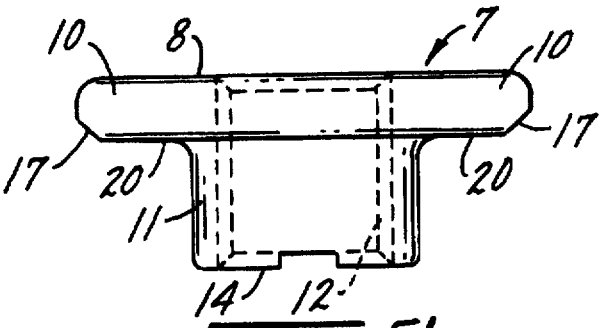
FIG. 5(*a*) is an end elevational view of a fastener.
Figure 5A:
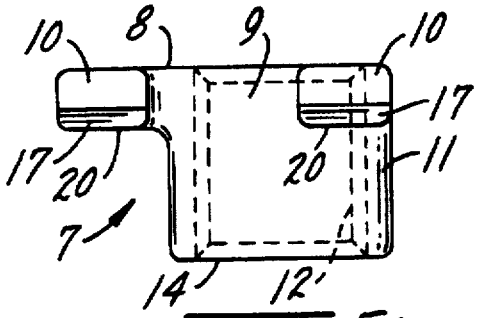
Figure 5C:
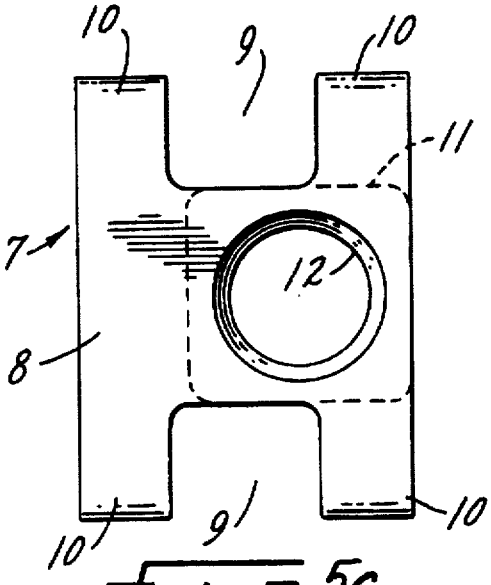

The flanges 5 are each provided with a recess 6, which is shaped in such a way that the fastening part 7, which is represented in FIGS. 5(*a*), (*b*), (*c*) in various views, can be inserted therein. The fastening part is of approximately T-shaped construction and consists of electrically conductive material. The upper part 8 of the fastening part is essentially rectangular and is provided with two oppositely located notches 9, four outwardly pointing arms 10 being formed. At the same time, the length of the arms is so dimensioned that the latter extend, after the introduction of the fastening part into the correspondingly shaped recess 6 in the flange, as far as the outside of the said flange. The form-locking reception of the fastening part in the flange ensures that the said part cannot turn when the plug-in connector is bolted on. In the downward direction, the fastening part has a stud 11 and is provided with a continuous threaded bore 12.

When the plug-in connector is manufactured, the metal shield 4 is inverted over the insulating body 3, after the introduction of the fastening part into the flange. In the region of the arms 10 of the fastening part, the metal shield has cut-out tongues 13, in each case, which are stamped inwardly and pressed, in the process, under the same arms, and first of all arrest the fastening part, so that the latter is held in the flange in a loosenable manner. As can be seen in FIG. 3, the stud 11 of the fastening part is constructed so as to only have a length such that a small gap or interval is left between its underside 14 and the underside 15 of the flange. When the plug-in connector is put on, and bolted onto, a fastening surface, such as a printed circuit board 16 for example, the fastening part is drawn against the printed circuit board, the edges 17 of the arms being pressed against the resilient tongues 13 and a good electrical connection being produced in the process between the tongues/metal shield and the fastening part. The electrical connection to the fastening surface/printed circuit board is produced either by direct pressing of the underside of the fastening part onto the fastening surface or else via the fastening bolt 18 and its head which bears, in a contact-making manner, against the underside of the fastening surface/printed circuit board.

Figure 6:
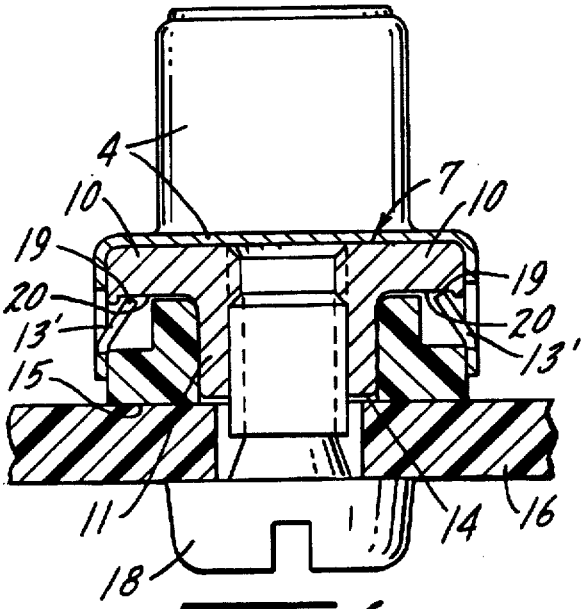
FIG. 6 is a section through the flange of the plug-in connector illustrated in FIG. 1, with a modified arrangement for making contact with the fastening part.

FIG. 6 represents a modified arrangement for making contact with the fastening part 7. In this instance, the tongues 13' are cut out in the opposite manner to the exemplified embodiment represented in FIGS. 1 and 3. These tongues 13' are also bent inward after the introduction of the fastening part. In this case, their free ends 19 pass under the underside 20 of the arms 10 of the fastening part, and the edges of the tongues are pressed against it. Under these circumstances, a good electrical connection between the tongues/metal shield and the fastening part is achieved when the plug-in connector is bolted on subsequently.

Whereas the preferred form of the invention has been shown and described herein, it should be realized that there may be many modifications, substitutions and alterations thereto.

The embodiments of the invention in which an exclusive property or privilege is claimed are defined as follows:

1. A plug-in connector of the type which attaches to a fastening surface of a printed circuit board, said connector including an elongated insulated body (3) terminating in opposite located ends, a fastening flange (5) formed at each of said ends, a recess (6) formed in each of said fastening flanges, a pair of fastening parts (7), a metal screen (4) of inverted box shape and cut-out tongues (13) formed in said metal screen, each of said fastening parts being generally T-shaped, formed of electrically conductive material and having an oppositely notched (9) head providing four outwardly extending arms (10), a stud (11) extending from said notched head of said fastening part and terminating in an underside (14), and a threaded passage (12) extending through said fastening part, one of said fastening parts being positioned in each of said recesses with its underside (14) spaced an interval from said fastening surface of said printed circuit board, said metal screen enclosing said elongated insulated body and said fastening parts with said cutout tongues (13) being pressed in and against said arms (10) of said notched heads of said fastening parts.

2. The plug-in connector of claim 1 in which said outwardly extending arms (10) have undersides (20), said cut-out tongues (13) having free ends (19) and said free ends of said tongues are pressed in against said undersides of said outwardly extending arms.

3. The plug-in connector of claim 1 in which upstanding protrusions are formed around said recess (6) of each fastening flange (5) and said oppositely notched (9) head engages said standing protrusions to limit rotation of said fastening part (7) relative to said fastening flange (5).

* * * * *